US007063189B2

(12) United States Patent
Curzon et al.

(10) Patent No.: US 7,063,189 B2
(45) Date of Patent: Jun. 20, 2006

(54) METHOD AND APPARATUS FOR A SCANNING AN ELEVATOR ENTRY WAY

(75) Inventors: John Vigurs Curzon, Witney (GB); Peter Ralph Collins, Witney (GB); Andrew James Butler-Miles, Witney (GB)

(73) Assignee: Airdri Limited, Witney (GB)

( * ) Notice: Subject to any disclaimer, the term of this patent is extended or adjusted under 35 U.S.C. 154(b) by 251 days.

(21) Appl. No.: 10/696,382

(22) Filed: Oct. 29, 2003

(65) Prior Publication Data

US 2004/0154873 A1 Aug. 12, 2004

(30) Foreign Application Priority Data

Oct. 30, 2002 (GB) ..... 0225242.7

(51) Int. Cl.
*B66B 1/34* (2006.01)

(52) U.S. Cl. ..... 187/391; 187/316; 187/901

(58) Field of Classification Search ..... 187/316, 187/317, 277, 901, 380–389, 391–398
See application file for complete search history.

(56) References Cited

U.S. PATENT DOCUMENTS 4,044,860 A * 8/1977 Kaneko et al. ..... 187/392
4,967,083 A * 10/1990 Kornbrekke et al. ..... 250/341.7
5,258,586 A * 11/1993 Suzuki et al. ..... 187/392
5,298,697 A * 3/1994 Suzuki et al. ..... 187/392
5,387,768 A * 2/1995 Izard et al. ..... 187/392
5,518,086 A * 5/1996 Tyni ..... 187/316
6,084,367 A * 7/2000 Landert ..... 318/466

FOREIGN PATENT DOCUMENTS

| | | | |
|---|---|---|---|
| EP | 0 839 750 A2 | | 5/1998 |
| EP | 0 953 537 A2 | | 3/1999 |
| GB | 2 093 986 A | | 9/1982 |
| JP | 01247390 A | * | 10/1989 |
| JP | 04148786 A | * | 5/1992 |
| JP | 05162939 A | * | 6/1993 |
| JP | 10-273272 | | 10/1998 |

* cited by examiner

*Primary Examiner*—Jonathan Salata
(74) *Attorney, Agent, or Firm*—Davis & Bujold, P.L.L.C.

(57) ABSTRACT

A lift system for and method of controlling a lift car. The car providing service to a number of separate stations to enable a person or an article waiting in a predetermined region outside the lift car to enter or leave the lift car. The method including the steps of providing the lift car a scanning device directed outwardly from the lift car. Each of the stations having an independent scanning extension. When the lift car arrives at one of the stations equipped with a scanning device, the scanning device and the scanning extension are juxtaposed to form an operable combination. Scanning the predetermined region with the operable combination to produce an output signal representing a state of the predetermined region, such as whether the region is occupied or not. Using the signal or a function of the signal to regulate subsequent operation of the lift car.

6 Claims, 1 Drawing Sheet

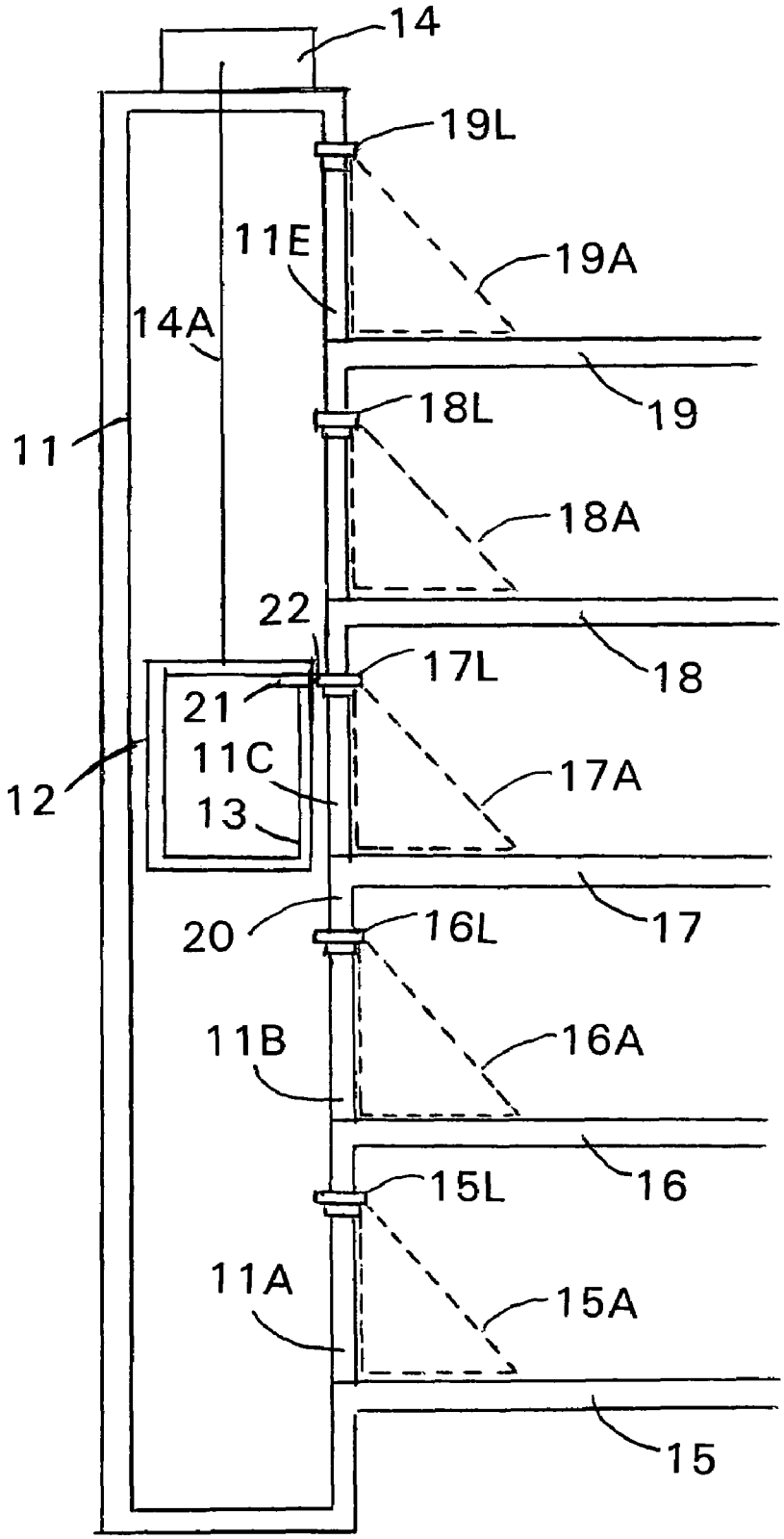
14
19L
11E
19A
14A
19
18L
11
18A
22
18
17L
21
11C
17A
12
13
20
16L
17
11B
16A
15L
16
11A
15A
15

METHOD AND APPARATUS FOR A SCANNING AN ELEVATOR ENTRY WAY

This application claims priority from British Application Serial No. 0225242.7 filed Oct. 30, 2002.

FIELD OR THE INVENTION

This invention relates to method and apparatus for a sensory system. It is particularly, but exclusively, intended for use in relation to a lift or elevator.

BACKGROUND OF THE INVENTION

In providing a sensory system for a lift there is a need to ensure safe operation of the system as a whole. This would include regulating opening and closing of doors of a lift door of a car so that in operation they do not hazard anyone entering or leaving the car. There have in the past been provided a number of systems seeking to control door operation which have varied in effectiveness and complexity.

SUMMARY OF THE INVENTION

According to a first aspect of the present invention there is provided a method of sensory control for a lift car located in an lift shaft which serves to define a number of separate stations between which the car can be driven and at each of which stations the car can be caused to stop to enable a person or an article to enter or leave the car characterised by the steps of:

1 providing for the car a scanning device;

2 providing at each of at least two or more of the stations an independent scanning extension means;

3 providing that on, or following, the arrival of the car at one of the stations equipped with an scanning extension means the scanning device and the scanning extension means at the station are juxtaposed, or otherwise linked, to form an operable combination;

4 scanning by means of the operable combination a predetermined region associated with the shaft at the station so as to provide as an output a signal representing a state of the predetermined region, such as whether it is occupied or not, and 5 using the signal or a function thereof, in the event the signal or a function thereof represents a predetermined condition, to regulate subsequent operation of the lift car.

According to a first preferred version of the first aspect of the present invention the scanning step is undertaken by way of a scanning device embodied as a camera and a scanning means incorporating a refractive or a reflective component to provide for a view of the pre-determined area to be conveyed by way of the scanning means to the scanning device.

According to a second aspect of the present invention there is provided a lift system wherein an lift car is located in a lift shaft which serves to define a number of separate stations at each of which the car can be caused to stop to enable a person to enter or leave the car characterised by the provision of a scanning device supported on, or by, the car, and a scanning extension means which, at least when the car is stopped at a given station, is juxtaposed or otherwise linked to the scanning device to provide a combination unit directed to a predetermined region relative to the given station whereby the scanning device is adapted to provide on an output channel of a signal representing a state of the predetermined region.

According to a first preferred version of the second aspect of the present invention the scanning device is a camera and the scanning extension means incorporates a refractive or a reflective component whereby a view of the pre-determined area is conveyed by way of the scanning means to the scanning device.

An exemplary embodiment of the invention will now be described wit reference to the accompanying drawings comprising a diagrammatic view of a lift system.

In this case the lift car described is one is moved by a traction system making use of a hoist and cable. However the system is equally applicable to hydraulically powered lift systems.

BRIEF DESCRIPTION OF THE DRAWINGS

The drawing shows a lift shaft 11 having a lift car 12 with a car door 13. The lift car 12 is displaced by means of a hoist 14 and cable 14A so that the car 12 can be raised or lowered to align with any one of five floors, respectively floors 15 to 19, to which access to and from the lift car 12 can be gained by means of openings 11A–11E which open, respectively, onto floors 15 to 19 through lift shaft wall 20. Each opening 11A–11E is closed by a conventional door (not shown for the sake of clarity) which in normal operation is closed except when the lift car 12 is decked at the opening and the car door 13 is open.

DETAILED DESCRIPTION OF THE INVENTION

Each floor 15–19 has an access region, respectively access regions 15A–19A, situated immediately in front of the openings 11A–11E. People waiting for, or entering or leaving the lift car 12 at a given floor must necessarily occupy or pass through the corresponding access region for that floor. This region 17A can extend partway into the lift to include the area between the doors.

The hoist 14 is governed by means of a control system which has components and circuitry located in the lift car 12, at various points in the shaft 11 and in the region of the hoist 14. In the lift car 12, the control systems includes a digital camera 21 with its lens 22 directed outwardly towards the wall 20 of the lift shaft 11.

At each floor 15–19 in wall 20 there is provided a lens unit, respectively lens unit 15L–19L. When lift car 12 is decked at a given floor, in this case floor 17 is shown, the camera 21 is aligned with the lens unit 17L so as to act as an operable combination providing for the scanning of the access region 17A.

The combination serves to generate a signal representing a predetermined status for the access region 17A (for example nobody waiting, several waiting or a non-standard operating situation such as light failure, or whatever). The control system then establishes the required operating behaviour of the system. Typically the control system provides for the closure of the car door 13 and of the floor door in opening 11C given that the camera 21 does not detect the presence of individuals moving into or out of the car 12. In addition gap sensing means can be used to establish that there are no obstructions in the path of a closing door.

By using an operable combination involving the use of a single camera in the car 12 and a separate scanning extension for each floor (lens units 15L to 19L) an effective operating system can be readily installed able to sense a variety of operating conditions and to provide for the operation of a control system of providing enhanced user safety. The proposed system can be installed in new and existing lift systems.

The above exemplary embodiment involves camera system is located on the car and the lens part on each landing. This means that to be functional at each landing only the lens part need be replicated. This has the practical advantages of reduced installation time, reduced cost and higher reliability. The system can also be installed retrospectively. When the lift stops at any given landing, the system parts at that floor become uniquely combined with the parts on the car for function at that floor. Typically the combination can be made up of a minimal refractive and/or reflective conditioning element (lenses/mirror) at each landing and the camera and processing system (backend) on the car.

The camera of the embodiment can provide an output signal which can be used directly by the control system to provide for safe door operation. The picture provided by the camera can also be transmitted to a remote location so that activity in the scanned region can be monitored by an observer for security or other purposes.

The proposed system provides for a number of concepts to be applied. These include the following.

'Mechanical multiplexing'—the connection and continuity of a lens in the camera is established byway of the position of the lift within the shaft, rather that by some electrical switch.

'Self selection'—the lift does not need to be instructed which lens is to be connected as this is a default outcome of the lift going to a predetermined floor.

'Automatic task prioritisation'—The sensor ends up looking at the landing of highest priority once the lift stops at any landing by default.

'Self aligning'—the positioning of the lift is critical. Conveniently the camera can be used as a sensor to achieve this alignment.

Multiplexing processes could also be applied to allow for a number of other functions to be included in the system environment. For instance for security or capacity estimation.

The sensing signals can be handled in an environment where a distributed sensor system, that is a sensor systems with multiple signal portals or front ends, are connected to a single processing system one at a time by a switching means. The sensor system is partitioned such that minimal hardware is present and repeated at each desired floor served by the lift, whilst a singular processing system is typically located on the travelling car. This system topology allows each landing space to be scanned at critical times as if a complete system was installed at every landing, yet with the benefits of a simplified implementation.

According to another aspect of the present invention there is provided a sensor system comprising of a plurality of portals through which signals can enter the sensor environment, multiplexed into a single signal processing system so that the movement of the lift forms a mechanically multiplexed switch whereby connection and continuity of each signal path is determined by the position of the lift car within the lift shaft and at any landing the sensor environment is uniquely connected to the signal portal by mechanical alignment and signal continuity achieved by radiated or conducted means.

The embodiment is directed towards a lift control system. However it could also be readily applied to other systems and equipment where for safe operation it is necessary to establish that a particular area is, for example, not occupied or alternatively is occupied or is in some required state before the system or equipment is caused to operate. In a broad based view the proposed system requires a scanning unit which can be physically linked to one of a plurality of scanning extension units to provide an operable combination whereby a region in the vicinity of a given extension unit can be monitored to establish a characteristic of the region. The scanning unit can be displaced along a path associated with each of the extension units. The scanning unit incorporates means for converting the scanned input to an output signal for subsequent processing. Typically the system could be used for metal pressing operations, foundry operation, chemical processing, security operations and so on.

The invention claimed is:

1. A method of controlling a lift car located in a lift shaft, which serves to define at least two or more stations between which the lift car can be driven and at each of the at least two or more stations the lift car can be caused to stop to enable at least one of a person and an article to one of enter and leave the lift car, the method comprising the steps of:

providing the lift car with a scanning device directed outwardly from the lift car;

providing an independent scanning extension at each of the at least two or more stations;

upon arrival of the lift car at one station of the at least two or more stations equipped with the scanning extension, aligning the scanning device with the scanning extension at the one station in a juxtaposed arrangement to form an operable combination;

scanning a predetermined region of the one station by the operable combination to provide an output signal representing a state of the predetermined region indicating whether or not the predetermined region is occupied; and using one of the output signal and a function of the output signal, in an event one of the output signal and the function of the output signal represents a predetermined condition, to regulate subsequent operation of the lift car.

2. The method of sensory control according to claim 1, further comprising the step of scanning the predetermined region by way of a scanning device embodied as a camera and the scanning extension incorporating one of a refractive and a reflective component to provide for a view of the predetermined region to be conveyed to the scanning device.

3. A lift system having a lift car located in a lift shaft which serves to define a number of separate stations, the lift car being stoppable at each of the separate stations to enable a person to one of enter and leave the lift car, the lift system comprising a scanning device, supported by the lift car, and being directed outwardly of the lift car, a scanning extension at each of the separate stations at which the lift car can be stopped, and when the lift car is stopped at a given station, the scanning extension is juxtaposed with the scanning device of the given station to provide a combined unit directed at a predetermined region of the given station, and the scanning device is adapted to provide on an output signal representing a state of the predetermined region.

4. The lift system according to claim 3, wherein the scanning device is a camera and the scanning extension incorporates one of a refractive and a reflective component whereby a view of the predetermined region is conveyed to the scanning device.

5. The lift system according to claim 3 wherein a sensor system, comprising a plurality of portals through which signals representing states of the predetermined regions can enter a sensor environment and be multiplexed into a single signal processing system so that movement of the lift forms a mechanically multiplexed switch whereby connection and continuity of each signal path is determined by a position of the lift car within the lift shaft and at any station the sensor environment is uniquely connected to the signal portal by mechanical alignment and signal continuity achieved by one of radiated means and conducted means.

6. A method of scanning an area adjacent an elevator entry of an elevator, the elevator having an elevator car located in an elevator shaft and the elevator providing service to at least two floors, the method comprising the steps of:

providing the elevator car with a camera mounted thereon with the camera facing outwardly from the elevator car;

providing one of a reflective and a refractive component at each of the at least two floors;

when the elevator car stops at a desired floor of the at least two floors, aligning the scanning device with one of the reflective and the refractive component to form an operable combination;

scanning the elevator entry with the operable combination to provide an output signal representing an elevator entry state indicating whether or not the elevator entry is occupied; and using one of the output signal and a function of the output signal to regulate subsequent operation of the elevator car when one of the output signal and the function thereof represents a predetermined condition.

* * * * *